US005887600A

United States Patent [19]

Wilk

[11] Patent Number: 5,887,600

[45] Date of Patent: Mar. 30, 1999

[54] HAIR CURLING BRUSH AND METHOD OF USING SAME

[76] Inventor: Sue Wilk, 5928 E. Weaver Cir., Englewood, Colo. 80111

[21] Appl. No.: 996,623

[22] Filed: Dec. 23, 1997

[51] Int. Cl.[6] ..... A45D 2/24

[52] U.S. Cl. ..... 132/262; 15/206; 15/176.1; 15/176.6; 132/266; 132/150

[58] Field of Search ..... 132/122, 150, 132/223, 226, 237, 242, 245, 250, 261, 262, 266, 267, 238, 239; 15/206, 27, 176.1, 176.2, 176.3, 176.4, 176.5, 176.6

[56] References Cited

U.S. PATENT DOCUMENTS

| | | | |
|---|---|---|---|
| 2,493,329 | 1/1950 | Wirth . | |
| 2,888,019 | 5/1959 | Whitmore . | |
| 3,224,454 | 12/1965 | Quino et al. . | |
| 3,369,265 | 2/1968 | Halberstadt et al. . | |
| 3,413,984 | 12/1968 | Tracy et al. | 132/238 |
| 3,431,571 | 3/1969 | Kraus | 15/179 |
| 3,757,376 | 9/1973 | Coombes | 15/176.1 |
| 3,890,984 | 6/1975 | Lesetar . | |
| 3,909,868 | 10/1975 | Noques | 15/27 |
| 3,955,064 | 5/1976 | Demetrio et al. | 132/232 |
| 3,967,630 | 7/1976 | Zuhlsdorff et al. | 132/262 |
| 4,167,192 | 9/1979 | Arnold | 15/206 |
| 4,197,608 | 4/1980 | Holley et al. . | |
| 4,329,567 | 5/1982 | Kunz et al. . | |
| 4,368,376 | 1/1983 | Andis . | |
| 4,411,281 | 10/1983 | Doern . | |
| 4,468,554 | 8/1984 | Andis . | |
| 4,471,507 | 9/1984 | Schwartz . | |
| 4,496,825 | 1/1985 | Andis . | |
| 4,605,023 | 8/1986 | Modin . | |
| 4,656,684 | 4/1987 | Jewett . | |
| 4,683,604 | 8/1987 | Rueb . | |
| 4,685,165 | 8/1987 | Fronius . | |
| 4,695,704 | 9/1987 | Andis . | |
| 4,712,570 | 12/1987 | Caccioppo . | |
| 4,811,445 | 3/1989 | Lagieski et al. . | |
| 5,072,477 | 12/1991 | Pai . | |
| 5,133,372 | 7/1992 | Seja et al. . | |
| 5,172,447 | 12/1992 | Tomm . | |
| 5,231,999 | 8/1993 | Schroettner | 132/150 |
| 5,253,948 | 10/1993 | Butler . | |
| 5,318,052 | 6/1994 | Ivabov | 132/237 |
| 5,343,880 | 9/1994 | McKay | 132/116 |
| 5,412,828 | 5/1995 | Kuhlmey et al. . | |
| 5,479,951 | 1/1996 | Denebeim . | |
| 5,526,829 | 6/1996 | Smith . | |
| 5,557,871 | 9/1996 | LaLonde | 15/206 |
| 5,573,016 | 11/1996 | Graves . | |
| 5,584,088 | 12/1996 | Pauldine . | |

FOREIGN PATENT DOCUMENTS

| | | | |
|---|---|---|---|
| 845054 | 8/1939 | France | 132/122 |

OTHER PUBLICATIONS

Apr. 20, 1998 Declaration of Sue Wilk (with Nondisclosure Agreement and Photographs/Figures from Brochure).

Copy of Drawing Sheet 1 of U.S. Patent No. 3,386,453 to Roberts et al. granted Jun. 4, 1968.

Copy of Drawing Sheet 1 of U.S. Patent No. 3,431,571 to Kraus granted Mar. 11, 1969.

*Primary Examiner*—Todd E. Manahan
*Assistant Examiner*—Eduardo C. Robert
*Attorney, Agent, or Firm*—Sheridan Ross P.C.

[57] ABSTRACT

A brush used for curling hair and a method of using same is disclosed. The brush includes a brush cartridge and a handle. The brush cartridge includes an adapter which may be removably connected to the handle. The method includes the steps of: (1) providing a brush having a handle and a brush cartridge, the brush cartridge having an adapter connected to one of its ends, the adapter permitting the brush cartridge and the handle to be removably connected to one another; (2) rolling a group of hair to be curled around the brush cartridge; (3) directing heat at the group of rolled-up hair and the brush cartridge to dry the group of rolled-up hair and to heat the brush cartridge; and, (4) detaching the handle from the brush cartridge. The present invention adapts different size brush ends to one handle for use as a set or individually to style a portion or an entire head of hair.

20 Claims, 7 Drawing Sheets

HAIR CURLING BRUSH AND METHOD OF USING SAME

FIELD OF THE INVENTION

The present invention is directed to hair curling devices, and more particularly, to hair curling brushes.

BACKGROUND OF THE INVENTION

A variety of methods have been developed to assist in curling hair. Most of these methods require dry hair in order to most effectively set the desired curl. For example, as shown in FIGS. 1 and 2, rollers 10 have been used to curl hair and, as shown in FIG. 3, curling irons 20 were later developed for the same purpose.

Referring to FIGS. 1 and 2, the rollers 10 have a metallic center portion 12 and non-metallic ends 14, which are usually made of plastic. The metallic center portion 12 is heated via hot rods 16 (see FIG. 2), while the non-metallic ends 14 remain cool. In using rollers, one must normally dry the hair, otherwise, the roller will not effectively curl the hair. Next, one must separate a group of hair to be curled (not shown), lift a roller 10 by its non-metallic ends 14, and roll the roller 10 by its ends 14 in such a way that the group of hair to be curled is wrapped around the center portion 12 of the roller. After some time, the hair to be curled is unrolled from the roller 10 and the desired curl is set.

Another method of curling one's hair is to use a curling iron 20 as shown in FIG. 3. The curling iron 20 has a central shaft 22 and a pivotable arm 24, which pivots in and out of contact with the central shaft 22. The central shaft 22 is heated, typically via electric current traveling through an internal heating coil (not shown).

The general method of curling one's hair using a curling iron is described below. First, the hair to be curled must be completely dried. Next, the pivotable arm 24 is pivoted out of contact from the heated central shaft 22 and the group of hair to be curled (not shown) is placed between the central shaft 22 and the pivotable arm 24. The pivotable arm 24 is then moved back towards the central shaft 22 engaging the hair to be curled between it and the central shaft 22. The curling iron 20 is then rotated about the axis of the central shaft 22 causing the hair to be rolled about the central shaft 22. A few minutes later, the curled hair is unrolled from the central shaft 22 and is released by the pivotable arm 24 as the pivotable arm 24 is pivoted out of contact from the heated central shaft 22.

There are many disadvantages associated with using either rollers or a curling iron to curl one's hair. For example, to be most effective in either instance, one must completely dry the hair prior to curling. A towel may be used, but this process can be quite time consuming and tiresome depending upon the length and thickness of the hair. Alternatively, a hair dryer may be used. However, the heat generated by a hair dryer can damage the hair. Moreover, subsequent use of a curling iron subjects the hair to intense and damaging heat on multiple occasions. In addition, when using rollers, because each roller 10 must be handled manually, there is a relatively strong risk that users of rollers may sustain burns by contacting the hot center portion 12 of the roller 10 against their skin.

In an effort to overcome the disadvantages of rollers and curling irons, a brush 30 (shown in FIG. 4) has been developed. The brush 30 has a metallic brush head 32 and a handle 34 fixedly attached thereto. The brush head 32 is hollow and has a plurality of apertures 36 therein. Bristles 38, which are supported by a support member 40 (see FIG. 5), protrude from the apertures 36.

The brush 30 is designed to be used in conjunction with a hair dryer (not shown) and permits hair to be effectively curled as it is being dried. Specifically, the hair to be curled is engaged by the bristles 38 of the brush 30 and is rolled about the brush head 32 by rotating the brush head 32 about its axis via rotation of the handle 34. Hot air is then directed, by a hair dryer, at the brush head 32 and the hair to be curled. Because the brush head 32 is metallic, it is heated relatively quickly by the hot air and allows heat to be distributed along its body. Furthermore, the plurality of apertures 36 allow heat to pass through the hollow brush head 32 to aid in heating the portion of the brush head 32 opposite the portion directly exposed to the flow of hot air.

After the brush head 32 is heated, the hair dryer is shut off and the brush 30 must be held in place for several minutes until it cools. This cooling period allows the curl to be set. The curled hair is then unrolled from the brush head 32.

One problem with such a brush is that one's arm may become fatigued by holding the brush in place while it cools, especially after curling a number of sections of one's hair. Another obvious problem with such a brush is the down time associated with allowing the brush to cool.

In order to make effective use of one's time when the brush 30 is cooling and to avoid the fatigue associated with holding a brush in place as it cools, some individuals have used a plurality of brushes to curl different sections of their hair. Doing so has presented a number of other problems.

For example, when more than one brush 30 is being used, the individual must let go of the handle 34 of the brush 30 which is cooling in order to position a second brush. The effect is that the weight of the handle 34 causes the brush head 32 to rotate, and, hence, causes the position and/or shape of the curl to be modified or lost altogether. Another problem with using multiple brushes is that the handles 34 of such brushes may obstruct a user and prevent her from being able to curl certain sections of her hair until one or more of the brushes has been removed.

Accordingly, there is a need for a curling brush which overcomes all of the problems described above.

SUMMARY OF THE INVENTION

It is an object of the invention to provide a brush for curling hair which: (1) does not require the hair to be dry; (2) permits multiple brush cartridges having multiple sizes to be used without unnecessarily obstructing a user with the brush handles associated with such brush cartridges; (3) minimizes the affect that the weight of a brush handle will have on the position or shape of a curl when multiple brush cartridges are used to curl hair; and (4) necessitates heating the hair only a single time.

In accordance with the invention, one embodiment of the curling brush includes a handle and a removable brush cartridge. The brush cartridge includes an adapter which may be removably connected to the handle.

A method of using a brush for curling hair is also disclosed herein. One embodiment of the method includes the steps of: (1) providing a brush having a handle and a brush cartridge, the brush cartridge having an adapter connected to at least one of its ends, the adapter permitting the brush cartridge and the handle to be removably connected to one another; (2) rolling a group of hair to be curled around the brush cartridge; (3) using one hand to direct heat at the group of rolled-up hair and the brush cartridge to dry the group of rolled-up hair and to heat-up the brush cartridge; and, (4) detaching the handle from the brush cartridge with the other hand while never having to turn off or set down the hair dryer with the first hand.

Other objects, features and advantages of the invention will be apparent from the following specification taken in conjunction with the following drawings.

DETAILED DESCRIPTION OF THE PREFERRED EMBODIMENT

Figure 2:
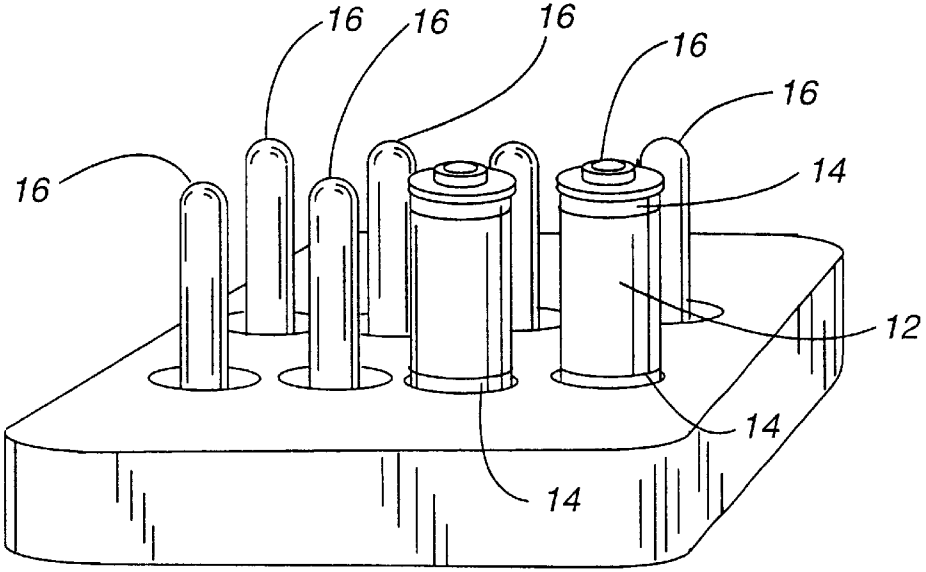
FIG. 2 Prior Art
FIG. 2 is a perspective view of a plurality of rollers conventionally mounted on heated rods which are used to heat the rollers.
Figure 3:
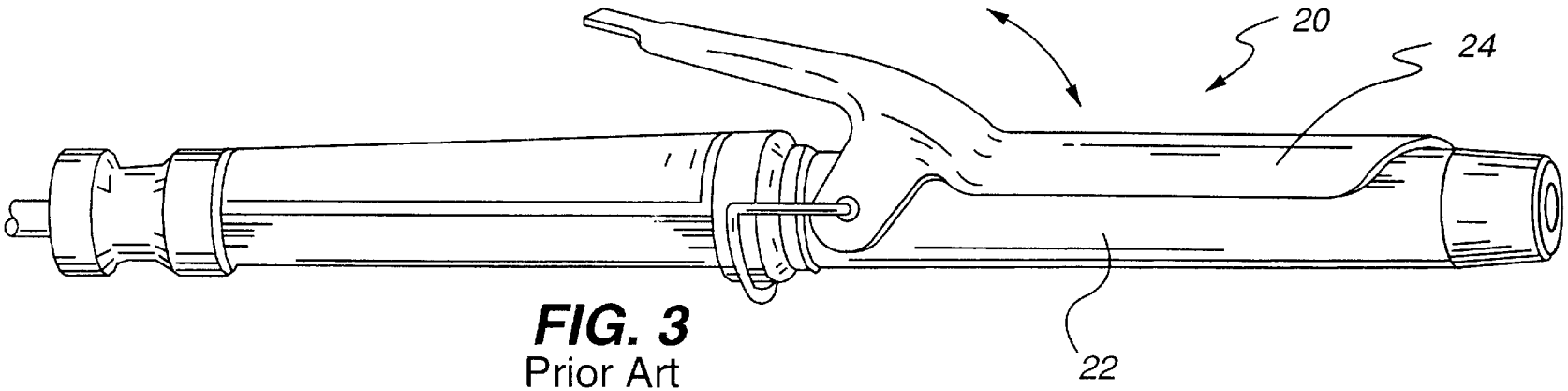
FIG. 3 Prior Art
FIG. 3 is a perspective view of a conventional curling iron.
Figure 1:
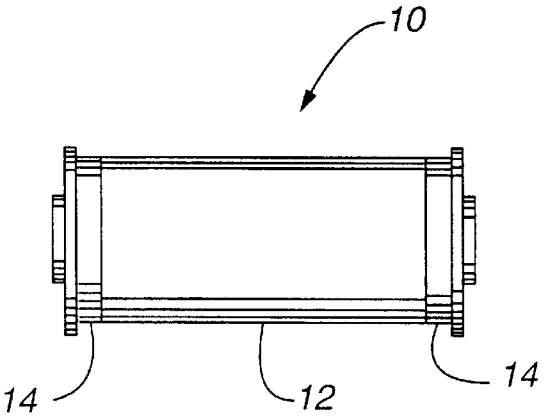
FIG. 1 Prior Art
FIG. 1 is a front view of a conventional roller used to curl one's hair.
Figure 4:
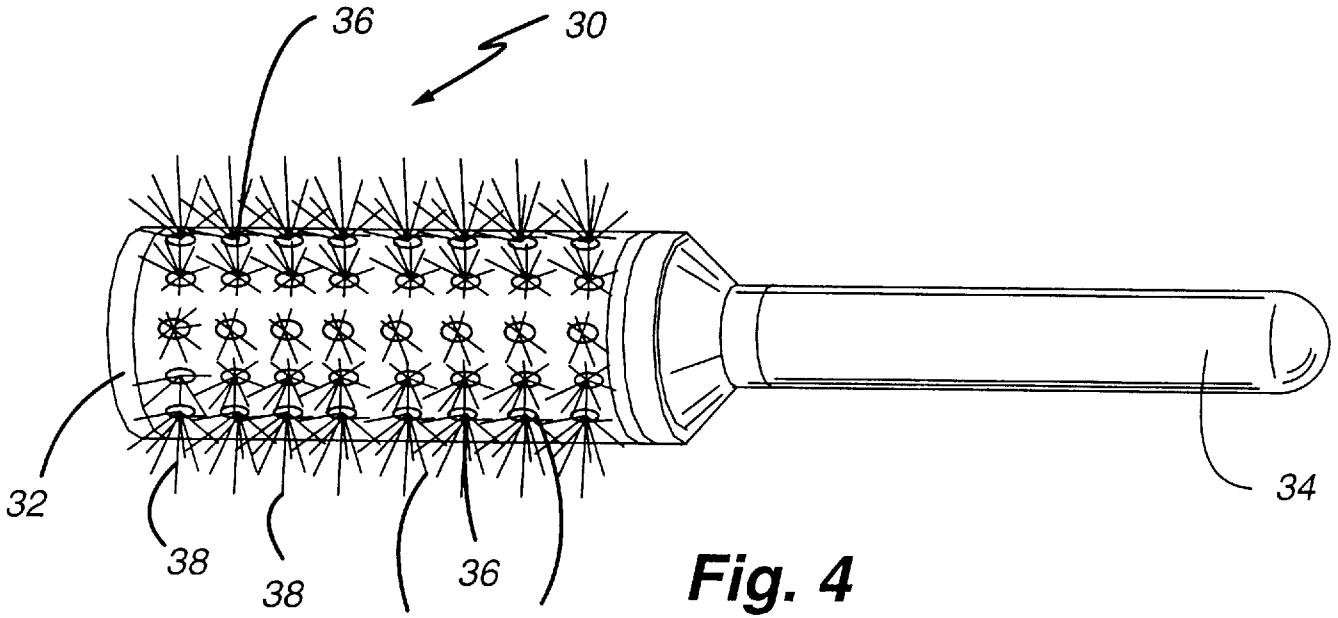
Fig. 4 Prior Art
FIG. 4 is a perspective view of a conventional curling brush.
Figure 5:
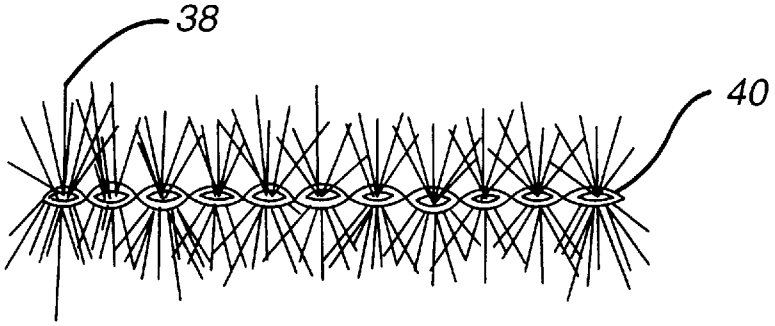
Fig. 5 Prior Art
FIG. 5 is a front view of conventional bristles supported by a support member.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

Figure 6:
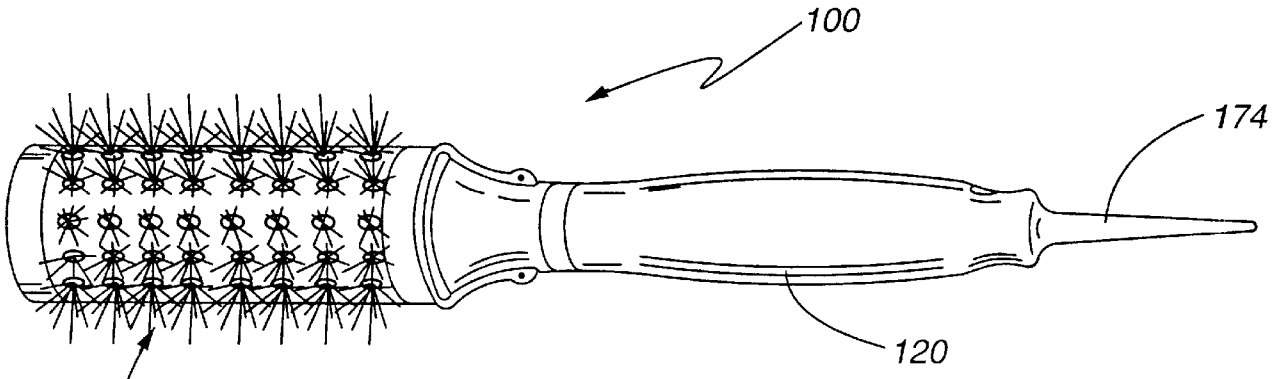
FIG. 6 is a perspective view of a curling brush in accordance with the present invention.
Figure 7:
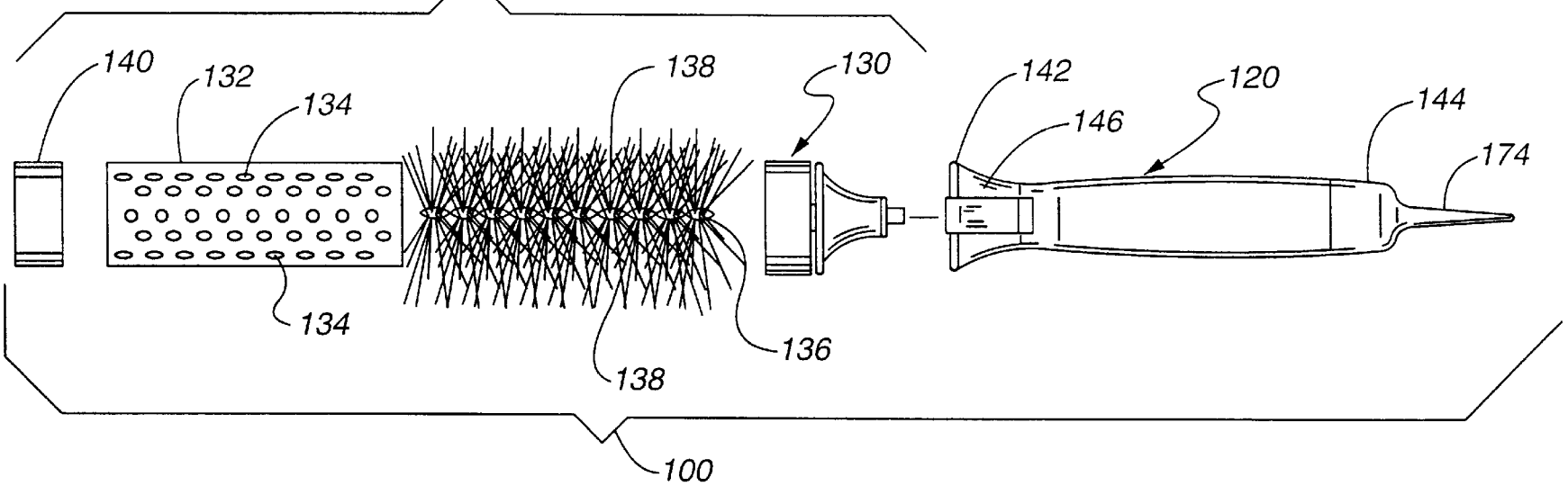
FIG. 7 is an exploded view of the curling brush of FIG. 6.

A brush, generally designated 100, used for curling hair is illustrated in FIGS. 6 and 7. The brush 100 includes a brush cartridge 110 and a handle 120.

Referring now to FIG. 7, the brush cartridge 110 includes an adapter 130 which is used to removeably connect the brush cartridge 110 to the handle 120. The brush cartridge 110 also includes a body 132 which is generally cylindrical in shape, is constructed of metal and has a plurality of apertures 134 therein. As will be understood by those skilled in the art, the plurality of apertures 134 permit the proper distribution of heat through and about the brush cartridge 110. Proper heat distribution is important for both drying and curling the hair to be curled. The apertures may be of varying size and spacing to promote the end result.

As shown in FIG. 7, the brush cartridge 110 also includes a support shaft 136 for supporting a plurality of bristles 138 which extend generally radially outwardly from the support shaft 136. When the brush 100 is fully constructed, the plurality of bristles 138 protrude through the plurality of apertures 134 which permits the plurality of bristles 138 to engage the hair to be curled.

Finally, the brush cartridge 110 includes an end cap 140 having a centrally located receptacle (not shown) for receiving the support shaft 136. The end cap 140 (via its centrally located receptacle) and the adapter 130 combine to center the support shaft 136 within the cylindrical body 132 of the brush cartridge 110.

The end cap 140 is preferably constructed of plastic, but may be metal. The advantage of a metal end cap 140 is that, by applying hot air to the end cap 140 via a hair dryer or the like (not shown), it permits heat to be distributed along the body 132 of the brush cartridge 110. On the other hand, while the characteristics of plastic end caps do not permit heat to be as easily distributed along the body 132 of the brush cartridge 110, a plastic end cap will not burn the hand of the user if contact occurs like a metal end cap could.

Still referring to FIG. 7, the handle 120 is generally cylindrical in shape and is preferably constructed of synthetic rubber. The handle 120 has first and second ends 142,144 and includes an integral cup-like member (or cup) 146 at its first end 142, which is preferably made of a pliable synthetic rubber material and is designed to receive the adapter 130 (not shown to scale). As will be understood by those skilled in the art, the cup 146 may be an element which is separately connected to the handle 120, such as with a screw thread attachment, instead of being integrally connected thereto.

As will be explained in further detail below, the cup 146 cooperates with the adapter 130 to hold the brush cartridge 110 and the handle 120 in fixed rotational relation to one another when the handle 120 is rotated about its axis as when rolling a group of hair about the brush cartridge. As will also be explained below, the cup 146 also cooperates with the adapter 130 to hold the handle 120 and the brush cartridge 110 in fixed relation to one another with respect to the direction of the axis of the handle 120.

In a preferred embodiment of the invention, the adapter 130 is fixedly connected to the body 132 at one end of the brush cartridge 110. In another embodiment of the invention, the adapter 130 may also be removably connected to the body 132 or may be disposed on either or both ends of the body 132.

Figure 9:
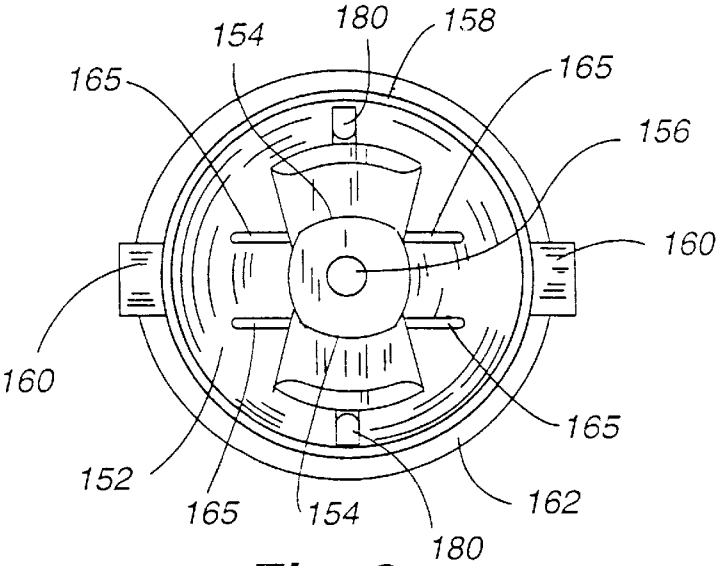
FIG. 9 is a top view of the handle shown in FIG. 8.
Figure 8:
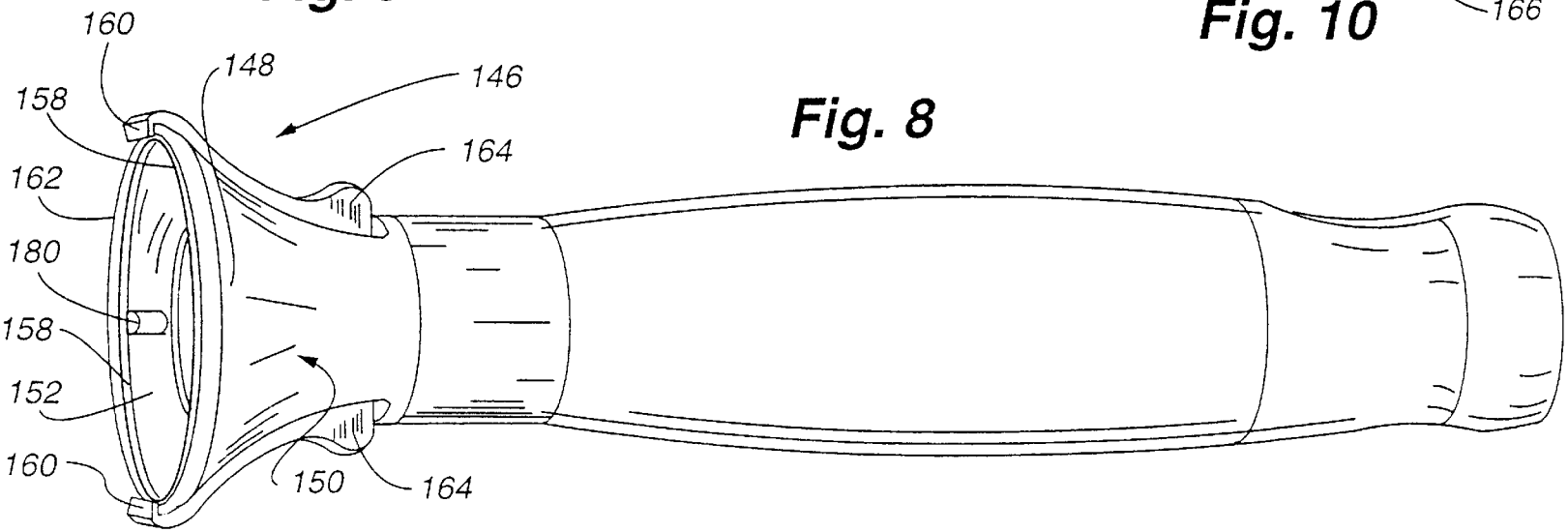
FIG. 8 is a perspective view of the handle of the brush shown in FIG. 7.

Referring now to FIGS. 8 and 9, the cup 146 has a first end 148 and a second end 150. The inside of the cup 146 has a generally frustoconical section 152 which leads into a plurality of walls 154 proximate its second end 150. The walls 154 form a polygonal shape (a square-shape in the depicted embodiment) and lead to a cup bottom 156.

A seat 158 lies proximate the first end 148 and extends around the periphery of the cup 146. A pair of flexible, resilient retainers 160, 160, adjacent to a lip 162, extend over at least a portion of the seat 158. In the preferred embodiment, the retainers 160, 160 are located approximately 180 degrees apart.

A pair of protrusions 164,164 are integrally formed on the outside of the cup 146 and are spaced approximately 180 degrees apart. The pair of protrusions 164,164 lie directly below the retainers 160, 160 and are used to disengage the adapter 130 therefrom with the ease of one hand. As shown in FIG. 9, one or more slots 165 may be formed in the wall of the cup 146 proximate the protrusions 164,164 and retainers 160,160 to further facilitate disengagement of the handle 120 from the adapter 130. More specifically, depressing the protrusions 164 causes the pliable cup 146 to flex and, accordingly, cause the adapter 130 to be ejected therefrom as will become apparent from the description which follows below.

Figure 10:
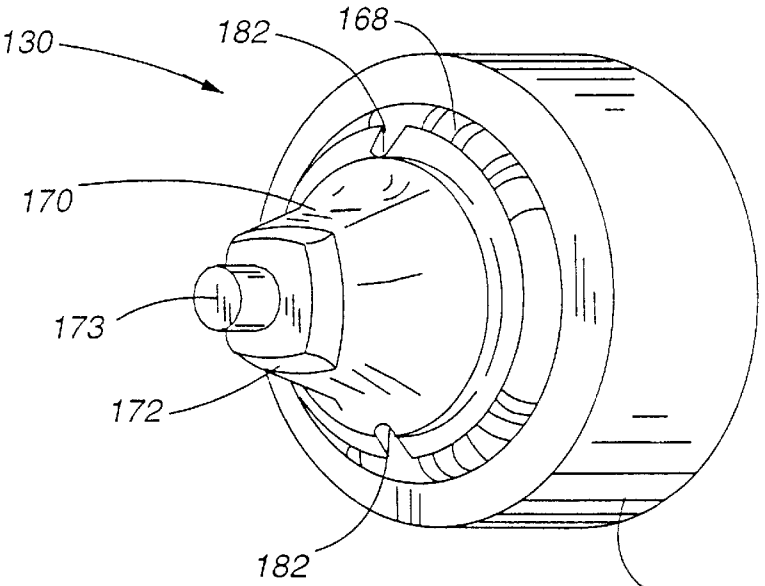
FIG. 10 is a perspective view of the adapter of the brush shown in FIG. 7.

With reference to FIG. 10, the adapter 130 includes a sleeve 166 sized to fit over one end of the body 132 of the brush cartridge 110. Glue, or some other comparable adhesive, may be used to connect the adapter 130 to the brush cartridge 110. Alternatively, the adapter 130 maybe attached to the brush cartridge 110 by screws or some other means, the only requirement being that the adapter 130 and the brush cartridge 110 are held in fixed relation to one another.

The adapter also includes a ring 168 (shown out of scale for illustrative purposes in FIG. 10), a generally frustoconical section 170 and a base 172. All of these elements are sized to cooperate with the corresponding elements found on the cup 146 (see FIGS. 8–10). Specifically, as will be understood by those skilled in the art, ring 168 is designed to be engaged by seat 158 and retainers 160,160; the adapter's frustoconical section 170 is designed to locate and lie flush with cup's frustoconical section 152; and, base 172 is designed to slide into walls 154 and create a rotational lock therebetween.

As shown in FIG. 10, the ring 168 is located between the sleeve 166 and the adapter's frustoconical section 170. Furthermore, the ring 168 is sized and positioned to be received by the seat 158 and the retainers 160 such that, when the adapter 130 is connected to the handle 120, the handle 120 and the brush cartridge 110 are held in fixed relation to one another with respect to the direction of the axis of the handle.

In the depicted embodiment, base 172 has a square shape which corresponds with the shape of the walls 154 of the cup 146. It should be understood that base 172 may take any polygonal shape so long as that shape corresponds with the polygonal shape of the walls 154 of the cup 146 and inhibits rotation relative to the handle. When the adapter 130 is connected to the handle 120, the base 172 and the walls 154 cooperate to hold the handle 120 and the brush cartridge 110 in fixed rotational relation to one another as the handle 120 is rotated about its axis. Additionally, a base extension member 173 may be positioned at the end of the base 172 to provide further stability to the interconnection of the members and to prevent lateral separation.

Finally, the brush 100 may include a hair separator 174 (shown in FIGS. 6 and 7) which is connected to the second end 144 of the handle 120. The hair separator 174 is used to separate a group of hair to be curled from the remainder of one's hair.

The operation and use of the brush 100 will now be described. Initially, the brush 100 is completely constructed, i.e., the brush cartridge 110 is connected to the handle 120 via adapter 130, as shown in FIG. 6.

The user then separates a group of hair to be curled (not shown), for example, with one's fingers or through use of the hair separator 174. Next, one places the brush 100 near the ends of the hair to be curled and causes the ends to be engaged by the plurality of bristles 138 of the brush 100. The brush 100 is then rotated about its axis, preferably by rotating the handle 120, which causes the hair to be curled to be rolled about the brush cartridge 110.

Heat, preferably by a hair dryer, is then directed at the group of rolled-up hair and the brush cartridge 110 so that the group of rolled-up hair is dried and so that the brush cartridge 110 becomes heated. Because the brush cartridge 110 is metallic, it is heated relatively quickly by the hot air from the dryer and it allows heat to be distributed along its body 132. Furthermore, the plurality of apertures 134 allow heat to pass through the hollow brush cartridge 110 to aid in heating the portion of the brush cartridge 110 opposite the portion directly exposed to the hot air from the dryer.

Figure 12A:
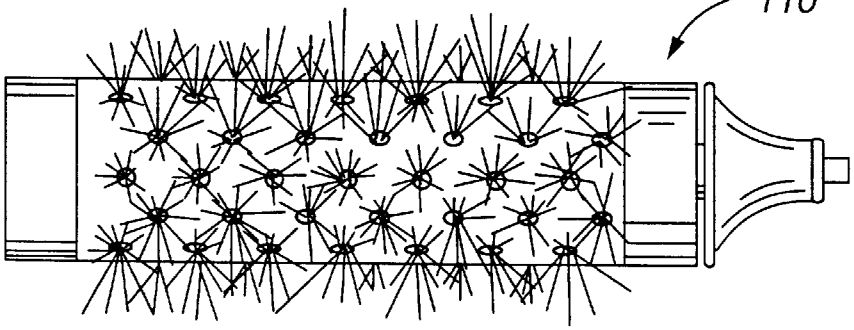
FIGS. 12*a* and 12*b* are plan views of the brush cartridge and handle of the present invention, respectively.
Figure 12B:
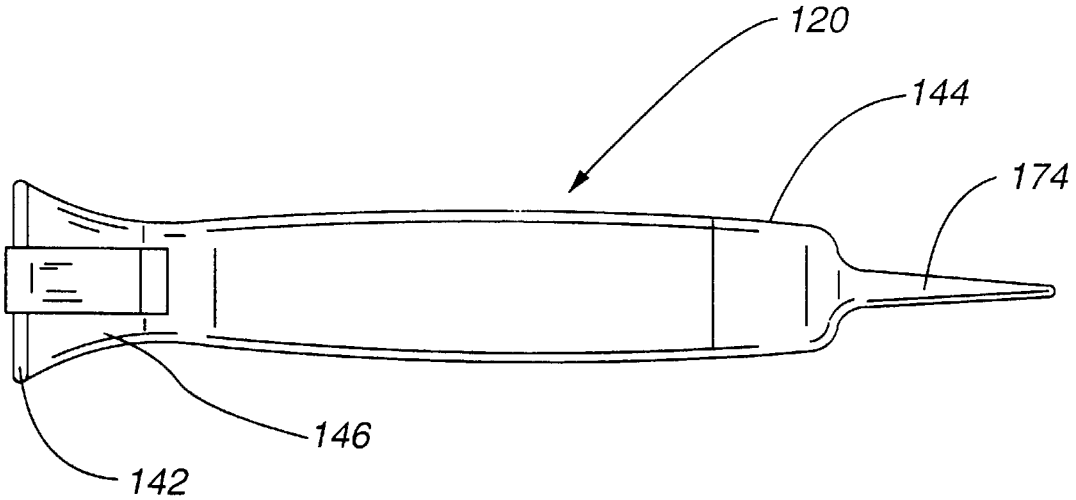

After the brush cartridge 110 is heated, the user detaches the handle 120 from the brush cartridge 110 by depressing protrusions 164. In more detail, depression of the protrusions 164 causes the cup 146 to flex and the ring 168 to both become unseated from within the seat 158 and to slip from the grasp of the retainers 160, so that the adapter 130, and hence the brush cartridge 110, is ejected from the handle 120 with one hand by pinching the protrusions. For clarity, FIGS. 12*a* and 12*b* illustrate the assembled brush cartridge 110 and the handle 120, respectively, detached from one another.

Figure 11:
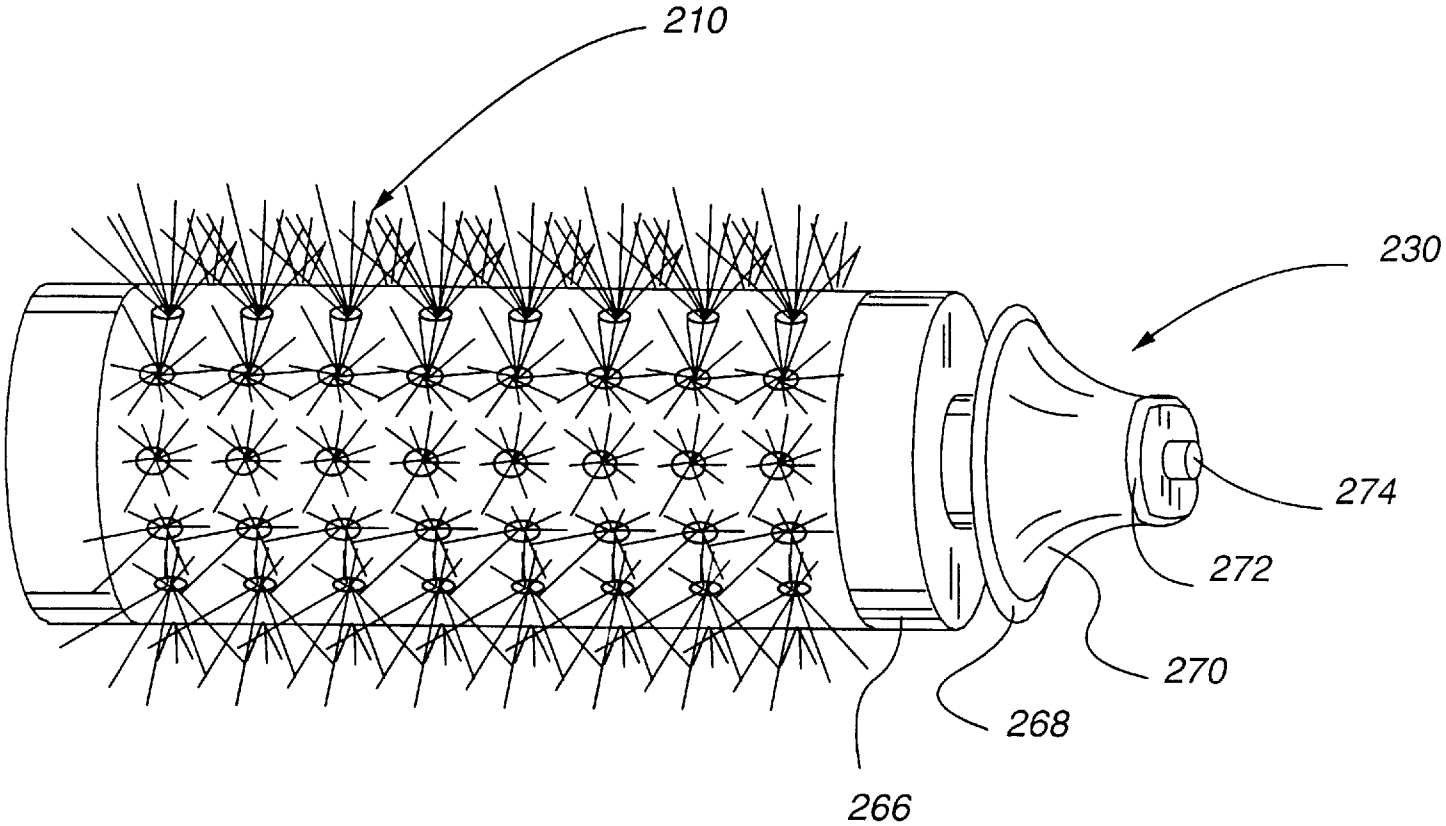
FIG. 11 is a perspective view of a second brush cartridge.

A second brush cartridge 210 (see FIG. 11), having an adapter identical to adapter 230, except, perhaps, for the diameter of its brush and sleeve 266, is then attached to the brush handle 120. In order to do so, however, the base 272 must be properly aligned with the walls 154 of the handle 120. Accordingly, the brush cartridge 210 or the handle 120 is rotated until the base 272 and the walls 154 are properly aligned. The brush cartridge 210 and the handle 120 are then forced towards one another so that the ring 268 is seated in the seat 158 and is grasped by the retainers 160. The brush, having second brush cartridge 210, is then used to curl a second group of hair to be curled in the same manner described above. This is repeated for the entire head of hair or only sections desired to be curled. In this same manner, multiple brush cartridges may be positioned in one's hair.

After brush cartridge 110 has had adequate time to cool, the brush cartridge 110 is simply unwound or gently pulled from the hair. There is no need to reattach it to the handle 120 to pull it out of the hair. A similar procedure is used for the second and any other brush cartridges 210.

It should be understood that the size of the brush cartridges may vary so that the user can select the sizes of the curls one wishes to create or to accommodate various hair lengths.

To further ensure that the handle 120 and the brush cartridge 110 remain in fixed rotational relation to one another when attached, the present invention can also include a plurality of anti-rotation protrusions 180,180 and a corresponding plurality of anti-rotation grooves 182,182 as best shown in FIGS. 9 and 10. In the preferred embodiment shown in FIG. 9, the anti-rotation a pair of anti-rotation protrusions 180,180 are spaced approximately 180 degrees apart from one another and are spaced approximately 90 degrees apart from retainers 160,160.

Figure 10A:
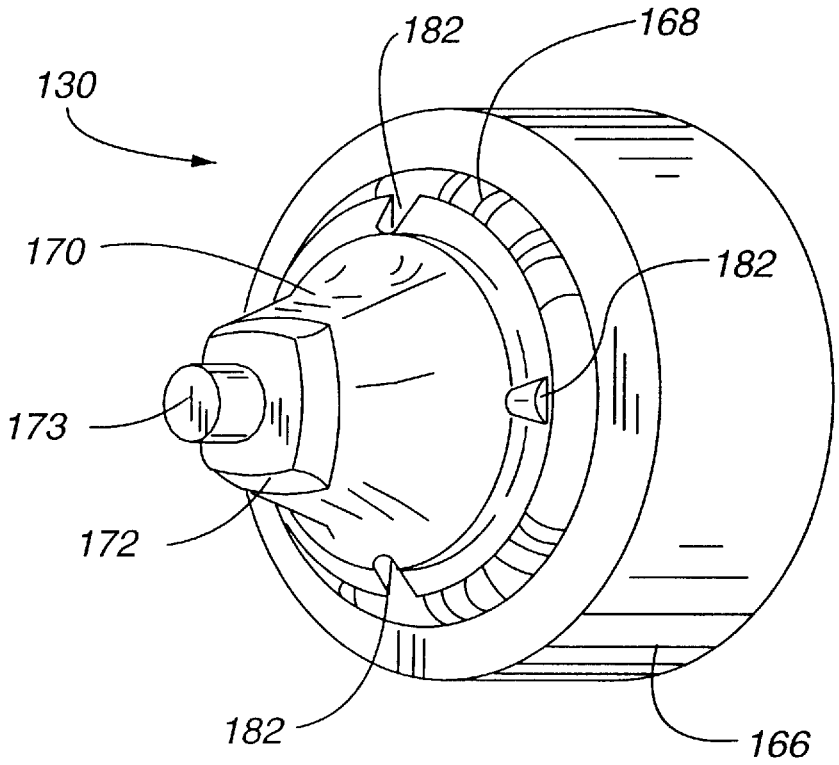
FIG. 10A is a perspective view of another embodiment of the adapter of the brush shown in FIG. 7 where the number of anti-rotational grooves exceed the number of anti-rotational protrusions shown in FIG. 9.

As will be understood by those skilled in the art, anti-rotation grooves 182,182 are located proximate the ring 168 to correspond with the anti-rotation protrusions 180,180 and engage the anti-rotation protrusions 180,180 when the adapter 130 and the handle 120 are properly connected. It should be noted that the number of anti-rotation grooves 182,182 may exceed the number of anti-rotation protrusions 180,180 to ease in connection of the adapter 130 to the handle 120 as shown in FIG. 10A.

It will be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. An apparatus used for curling hair comprising:

a brush cartridge;

a handle having a longitudinal axis, the handle further having a pair of ends and a cup at one of its ends, the cup having a seat proximate its periphery and at least a pair of retainers proximate the seat; and, an adapter disposed between the brush cartridge and the handle, the adapter being connected to the brush cartridge and being removably connected to the handle, the adapter having a ring, wherein the seat is adapted to receive the ring and wherein the retainers cooperate with the seat and the ring to hold the handle and the brush cartridge in fixed relation to one another along the direction of the longitudinal axis of the handle.

2. The apparatus of claim 1 wherein the brush cartridge has a plurality of apertures therein.

3. The apparatus of claim 2 wherein the brush cartridge includes a support shaft for supporting a plurality of bristles, the plurality of bristles protruding through the plurality of apertures.

4. The apparatus of claim 1 wherein the adapter includes a base which cooperates with the cup to hold the brush cartridge and the handle in fixed rotational relation to one another when the handle is rotated about its axis.

5. The apparatus of claim 4 wherein the cup has a first end and a second end, the cup further including a plurality of walls proximate its second end, the walls forming a polygonal shape.

6. The apparatus of claim 5 wherein the base has a complementary polygonal shape which corresponds with the shape of walls of the cup so that it fits into the cup.

7. The apparatus of claim 1 wherein the cup includes multiple protrusions thereon for releasing the brush cartridge from the handle.

8. The apparatus of claim 7 wherein the protrusions are spread apart from one another.

9. The apparatus of claim 7 wherein the protrusions are located proximate the retainers.

10. The apparatus of claim 9 including a hair separator connected to the handle.

11. An apparatus used for curling hair comprising:

a brush cartridge;

a handle;

an adapter disposed between the brush cartridge and the handle, the adapter being connected to the brush cartridge and being removably connected to the handle, wherein the handle includes a plurality of anti-rotation protrusions and the adapter includes a plurality of corresponding anti-rotation grooves to hold the brush cartridge and the handle in fixed rotational relation to one another when the handle and adapter are attached to one another and wherein the number of anti-rotation grooves exceed the number of anti-rotation protrusions.

12. A method of curling hair comprising the steps of:

providing a brush having a handle and a first brush cartridge, the handle having a longitudinal axis, the handle further having a pair of ends and a cup at one of its ends, the cup having a seat proximate its periphery and at least a pair of retainers proximate the seat, wherein at least a pair of protrusions are located on an outside of the cup, the first brush cartridge having an adapter connected to one of its ends, the adapter having a ring which is received by the seat, wherein the retainers, seat and ring cooperate with each other to hold the handle and first brush cartridge in fixed relation to one another with respect to the longitudinal axis of the handle;

rolling a group of hair to be curled around the first brush cartridge;

directing heat at the group of rolled-up hair and the first brush cartridge to dry the group of rolled-up hair and to heat the first brush cartridge; and, detaching the handle from the first brush cartridge, wherein the handle is detached from the first brush cartridge by a user directly physically depressing the protrusions located on the outside of the cup.

13. The method of claim 12 including the step of:

attaching the handle to a second brush cartridge in place of the first brush cartridge.

14. The method of claim 13 including the steps of:

rolling a second group of hair to be curled around the second brush cartridge;

directing heat at the second group of rolled-up hair and the second brush cartridge to dry the second group of rolled-up hair and to heat the second brush cartridge; and, detaching the handle from the second brush cartridge.

15. An apparatus used for curling hair comprising:

a brush cartridge;

a handle having a pair of ends and a cup at one of its ends, the cup having a frustoconically-shaped section and having a seat proximate its periphery, the cup further including retainers proximate the seat; and, an adapter disposed between the brush cartridge and the handle, the adapter being connected to the brush cartridge and being removably connected to the handle, the adapter having a frustoconically-shaped section corresponding to the frustoconically-shaped section of the cup, the seat of the cup being adapted to receive the ring, the retainers cooperating with the seat and the ring to hold the handle and the brush cartridge in fixed relation to one another with respect to the direction of a longitudinal axis of the handle.

16. The apparatus of claim 15 wherein the cup includes a plurality of protrusions and wherein the handle is detached from the brush cartridge by depressing the protrusions.

17. The apparatus of claim 15 wherein the retainers engage the ring of the adapter.

18. The apparatus of claim 17 wherein the retainers release the ring upon depression of the protrusions.

19. The apparatus of claim 18 wherein the retainers extend over at least a portion of the seat.

20. The apparatus of claim 18 wherein the frustoconically-shaped section of the cup is constructed of a flexible material so that when the protrusions, which are located on the frustoconically-shaped section of the cup, are squeezed the frustoconically-shaped section of cup is squeezed and the adapter is ejected from the cup.

* * * * *